US010611161B2

(12) United States Patent
Lin

(10) Patent No.: US 10,611,161 B2
(45) Date of Patent: Apr. 7, 2020

(54) IMAGE FORMING AGENT STORAGE MEMBER AND LASER PRINTER USING THE SAME

(71) Applicant: AVISION INC., Hsinchu (TW)

(72) Inventor: Chia-Hsin Lin, Hsinchu (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 15/418,116

(22) Filed: Jan. 27, 2017

(65) Prior Publication Data

US 2017/0136774 A1 May 18, 2017

Related U.S. Application Data

(63) Continuation-in-part of application No. 14/504,432, filed on Oct. 2, 2014, now Pat. No. 9,815,281.

(30) Foreign Application Priority Data

Jul. 24, 2014 (TW) ..... 103125348 A
Mar. 9, 2016 (TW) ..... 105107140 A

(51) Int. Cl.
*B41J 2/175* (2006.01)
*B41J 29/13* (2006.01)
*B41J 29/02* (2006.01)

(52) U.S. Cl.
CPC ..... *B41J 2/17523* (2013.01); *B41J 2/175* (2013.01); *B41J 2/17563* (2013.01); *B41J 29/02* (2013.01); *B41J 29/13* (2013.01)

(58) Field of Classification Search
CPC .... B41J 2/175; B41J 2/17523; B41J 2/17563; B41J 29/13; B41J 2/14; B41J 2/17503;
(Continued)

(56) References Cited

U.S. PATENT DOCUMENTS 5,396,316 A * 3/1995 Smith ..... G03G 15/104 396/282
5,455,662 A 10/1995 Ichikawa et al.
(Continued)

FOREIGN PATENT DOCUMENTS

CN 1113575 A 12/1995
CN 1087691 7/2002
(Continued)

*Primary Examiner* — Anh T Vo
(74) *Attorney, Agent, or Firm* — Muncy, Geissler, Olds & Lowe, P.C.

(57) ABSTRACT

An image forming agent storage member comprises a housing, an image forming agent supply port and a fluid discharge mechanism. The housing carries the image forming agent. The image forming agent supply port is disposed on one side surface of a short side of the housing. The fluid discharge mechanism is disposed on a long side of the housing. When the image forming agent supply port receives the image forming agent filled into the housing, a fluid inside the housing is discharged through the fluid discharge mechanism. The fluid discharge mechanism comprises a shielding member, and positions of the shielding member and the image forming agent supply port on the housing do not correspond to each other. A laser printer using the image forming agent storage member is also provided.

17 Claims, 13 Drawing Sheets

(58) Field of Classification Search
CPC ..... B41J 2/17506; B41J 2/17513; B41J 2/17533; B41J 2/17553; B41J 2/17556; B41J 2/17566; B41J 29/02; G03G 15/0867
See application file for complete search history.

(56) References Cited

U.S. PATENT DOCUMENTS

| | | | | |
|---|---|---|---|---|
| 5,500,663 | A | 3/1996 | Ujita | |
| 5,500,719 | A | 3/1996 | Ichikawa et al. | |
| 5,515,143 | A | 5/1996 | Shiotani | |
| 5,587,770 | A * | 12/1996 | Jo | G03G 15/0822 399/27 |
| 5,627,631 | A | 5/1997 | Ichikawa et al. | |
| 5,822,663 | A | 10/1998 | Ichikawa et al. | |
| 5,918,090 | A | 6/1999 | Ichikawa et al. | |
| 6,032,010 | A * | 2/2000 | Kim | B41J 2/1755 222/DIG. 1 |
| 6,075,963 | A | 6/2000 | Ichikawa et al. | |
| 6,164,768 | A | 12/2000 | Murphy et al. | |
| 6,209,995 | B1 * | 4/2001 | Grune | B41J 2/17503 347/85 |
| 6,264,316 | B1 * | 7/2001 | Chino | B41J 2/175 347/86 |
| 6,289,195 | B1 | 9/2001 | Ichikawa et al. | |
| 6,418,293 | B2 | 7/2002 | Ichikawa et al. | |
| 6,442,156 | B1 | 8/2002 | Carlstrom | |
| 6,460,982 | B1 * | 10/2002 | Ito | B41J 2/175 141/351 |
| 6,485,383 | B1 | 11/2002 | Hendricks | |
| 6,751,431 | B2 | 6/2004 | Ichikawa et al. | |
| 6,776,479 | B2 | 8/2004 | Ardito | |
| 6,901,230 | B2 | 5/2005 | Ichikawa et al. | |
| 7,458,665 | B2 | 12/2008 | Batista et al. | |
| 7,558,515 | B2 | 7/2009 | Kurita et al. | |
| 9,229,368 | B2 | 1/2016 | Okino et al. | |
| 9,815,281 | B2 * | 11/2017 | Lin | B41J 2/14 |
| 2002/0001485 | A1 | 1/2002 | Ichikawa et al. | |
| 2003/0138273 | A1 | 7/2003 | Ichikawa et al. | |
| 2004/0161267 | A1 | 8/2004 | Ichikawa et al. | |
| 2005/0011916 | A1 | 1/2005 | Battista et al. | |
| 2005/0012794 | A1 | 1/2005 | Chau | |
| 2005/0025528 | A1 | 2/2005 | Nagai et al. | |
| 2007/0046742 | A1 | 3/2007 | Inoue | |
| 2008/0240771 | A1 | 10/2008 | Kurita et al. | |
| 2012/0014722 | A1 | 1/2012 | Okino et al. | |
| 2012/0038719 | A1 * | 2/2012 | Shimizu | B41J 2/17523 347/86 |
| 2015/0277285 | A1 | 10/2015 | Okino et al. | |
| 2016/0023460 | A1 | 1/2016 | Lin | |

FOREIGN PATENT DOCUMENTS

| | | | |
|---|---|---|---|
| CN | 2520251 | Y | 11/2002 |
| CN | 1113575 | C | 7/2003 |
| CN | 2597202 | | 1/2004 |
| CN | 100333915 | | 8/2007 |
| CN | 101229723 | A | 7/2008 |
| CN | 101559679 | A | 10/2009 |
| CN | 201580055 | | 9/2010 |
| CN | 201784249 | U | 4/2011 |
| CN | 102101388 | A | 6/2011 |
| CN | 102371767 | A | 3/2012 |
| CN | 204077072 | | 1/2015 |
| CN | 105269952 | A | 1/2016 |
| TW | 240299 | B | 2/1995 |
| TW | I259336 | | 8/2006 |
| TW | I302231 | | 10/2008 |
| TW | 201413403 | | 4/2014 |
| TW | M483180 | | 8/2014 |
| TW | I494715 | B | 8/2015 |
| TW | 201546578 | A | 12/2015 |
| TW | 201604665 | | 2/2016 |

* cited by examiner

IMAGE FORMING AGENT STORAGE MEMBER AND LASER PRINTER USING THE SAME

This application is a Continuation-in-Part of application Ser. No. 14/504,432, filed on Oct. 2, 2014, now issued as U.S. Pat. No. 9,815,281 and for which priority is claimed under 35 U.S.C. 120; and this application claims priority of No. 105107140 filed in Taiwan R.O.C. on Mar. 9, 2016 under 35 USC 119, the entire content of which is hereby incorporated by reference.

BACKGROUND OF THE INVENTION

Field of the Invention

This disclosure relates to an image forming agent storage member and a peripheral using the image forming agent storage member, and more particularly to an image forming agent storage member capable of being refilled with an image forming agent and a peripheral using the image forming agent storage member.

Description of the Related Art

Peripherals, such as printers, copiers and the like, are indispensable apparatuses in an office. This type of peripheral has a printing module for forming predetermined patterns using image forming agents, such as toners, ink, or the like, coated on a medium (e.g., a sheet). Compared with the peripheral body, the image forming agent is consumptive and has to be replaced or refilled regularly. The frequently seen method is to replace a storage member (toner cartridge, ink cartridge or the like) with a new one filled with the image forming agent. However, this way costs higher, and disables the storage member from being used repeatedly so that the unused image forming agent is wasted. This is disadvantageous to the environment protection. In recent years, there is another practice to supply the image forming agent into the original storage member instead of replacing the storage member. For end users, the image forming agent or the storage member is not limited to a specific brand anymore so that end users are able to purchase a general supplemental package of the image forming agent. Thus, it reduces the cost and improves the convenience.

However, there are some problems in a process of injecting the image forming agent into the conventional storage member. The conventional structure for refilling the image forming agent is shown in FIGS. 1*a* and 1*b*, wherein an image forming agent refilling bottle 13 refills or resupplies an image forming agent from an image forming agent supply port 11 into an image forming agent storage member 10. The bottle mouth is designed to be sharp and long to facilitate the image forming agent in entering the storage member 10. However, when the image forming agent is entering the storage member 10, an air stream L1 from the refilling bottle to the image forming agent storage member is formed. Correspondingly, the internal air is discharged from a gap between the image forming agent supply port 11 and the bottle mouth, and an air stream L2 outputted from the image forming agent storage member and the refilling bottle mouth is scattered at the opening together with the image forming agent. For solving the above-mentioned problem, an auxiliary opening can be further designed for ventilation, but the image forming agent also tends to flow out from the auxiliary opening. The leaked image forming agent might harm a human body if entering the human body via skin or the respiratory tract, and moreover, the leaked image forming agent damages the multifunction product as well.

SUMMARY OF THE INVENTION

It is therefore an object of this disclosure to provide an image forming agent storage member capable of being refilled with an image forming agent and a peripheral using the image forming agent storage member, wherein the image forming agent can be easily refilled and stopped from leaving the image forming agent storage member. Thus, the environment protective, convenient and safe effects can be achieved, the overflow of the image forming agent can be stopped, and the user's refilling operation can be advantageously performed.

To achieve the above-identified object, this disclosure provides an image forming agent storage member comprising a housing, an image forming agent supply port and a fluid discharge mechanism. The housing carries an image forming agent. The image forming agent supply port is disposed on one side surface of a short side of the housing. The fluid discharge mechanism is disposed on a long side of the housing. When the image forming agent supply port receives the image forming agent added into the housing, a fluid in the housing is discharged through the fluid discharge mechanism. The fluid discharge mechanism comprises a shielding member, and positions of the shielding member and the image forming agent supply port on the housing do not correspond to each other.

In summary, this disclosure provides an image forming agent storage member capable of being refilled with the image forming agent and a peripheral using this image forming agent storage member, so that the image forming agent can be easily refilled and the image forming agent can be stopped from leaving the image forming agent storage member. The structure is light, the consumable material consumption is low, and the environment protective, convenient and safe effects can be obtained. It is possible to stop the image forming agent from over flowing, and it is advantageous to the user's refilling operation.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

FIGS. 6*a* and 6*b* are schematic views showing controlling of a shielding member in a fluid discharge mechanism, wherein FIG. 6*a* shows the closed state of the shielding member, and FIG. 6*b* shows the opened state of the shielding member.

DETAILED DESCRIPTION OF THE INVENTION

Figure 1A:
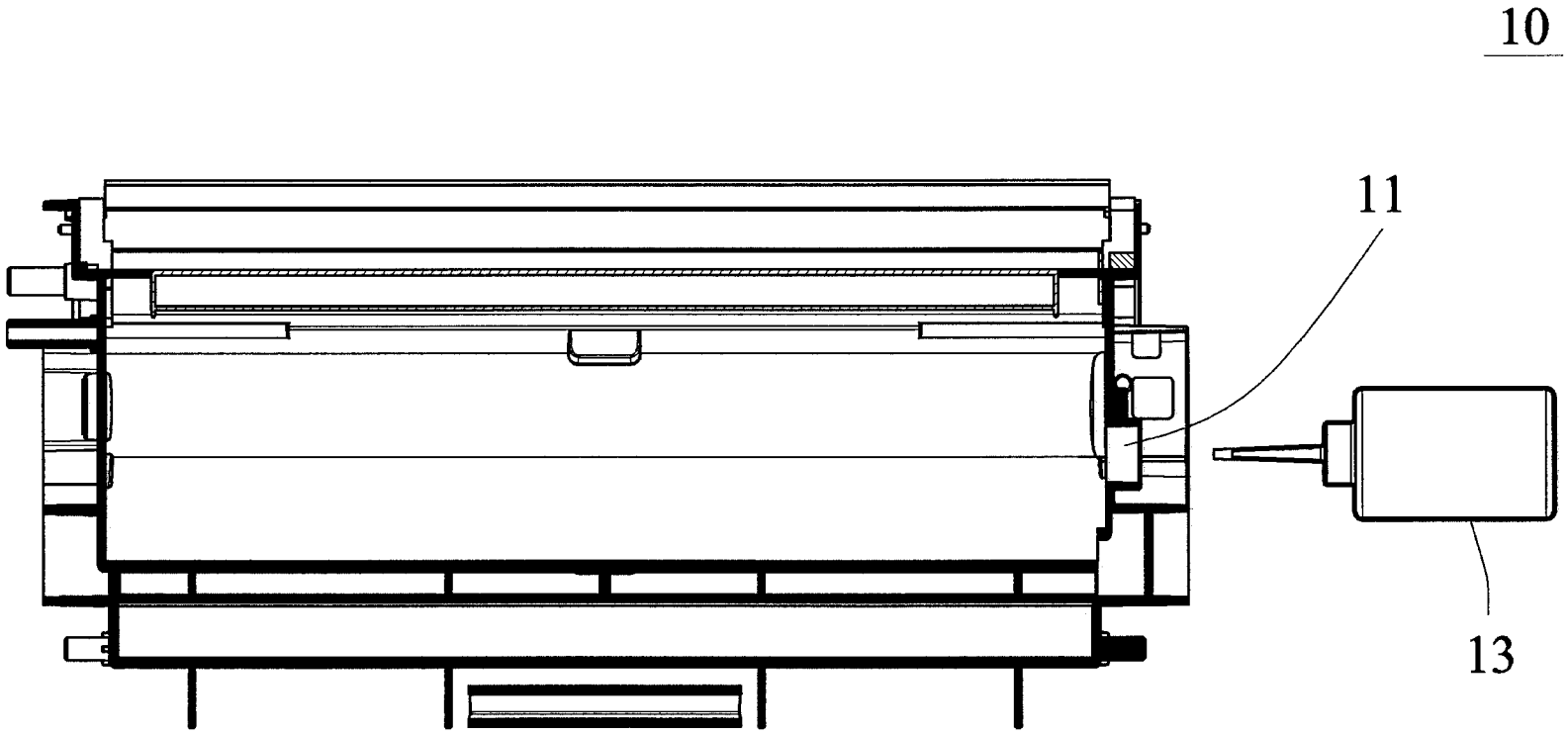
FIG. 1a (Prior Art)
FIG. 1*a* is a schematic view showing a mechanism of a conventional image forming agent storage member.
Figure 1B:
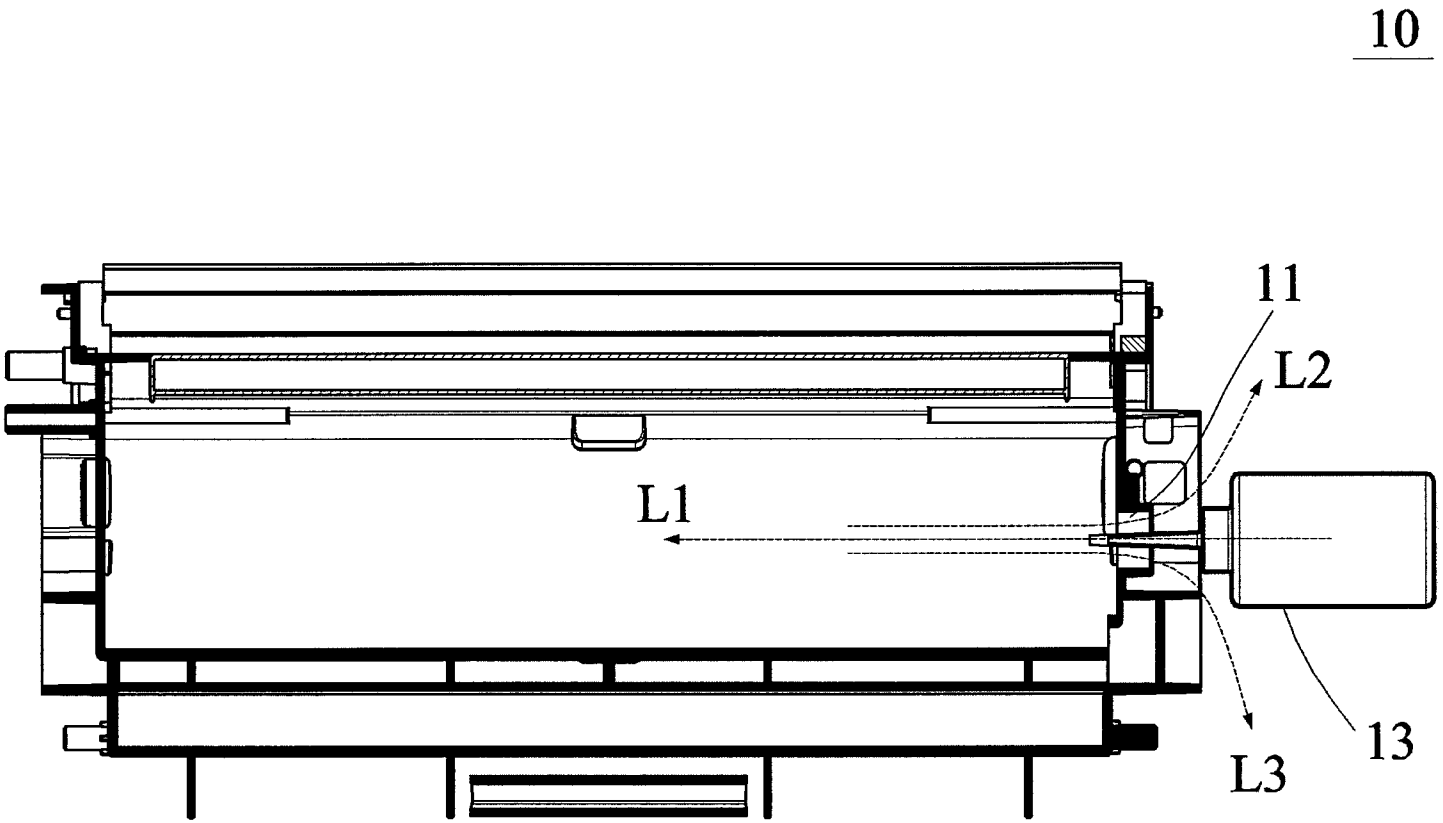
FIG. 1b (Prior Art)
FIG. 1*b* is a schematic view showing the mechanism of the conventional image forming agent storage member when being used.
Figure 2:
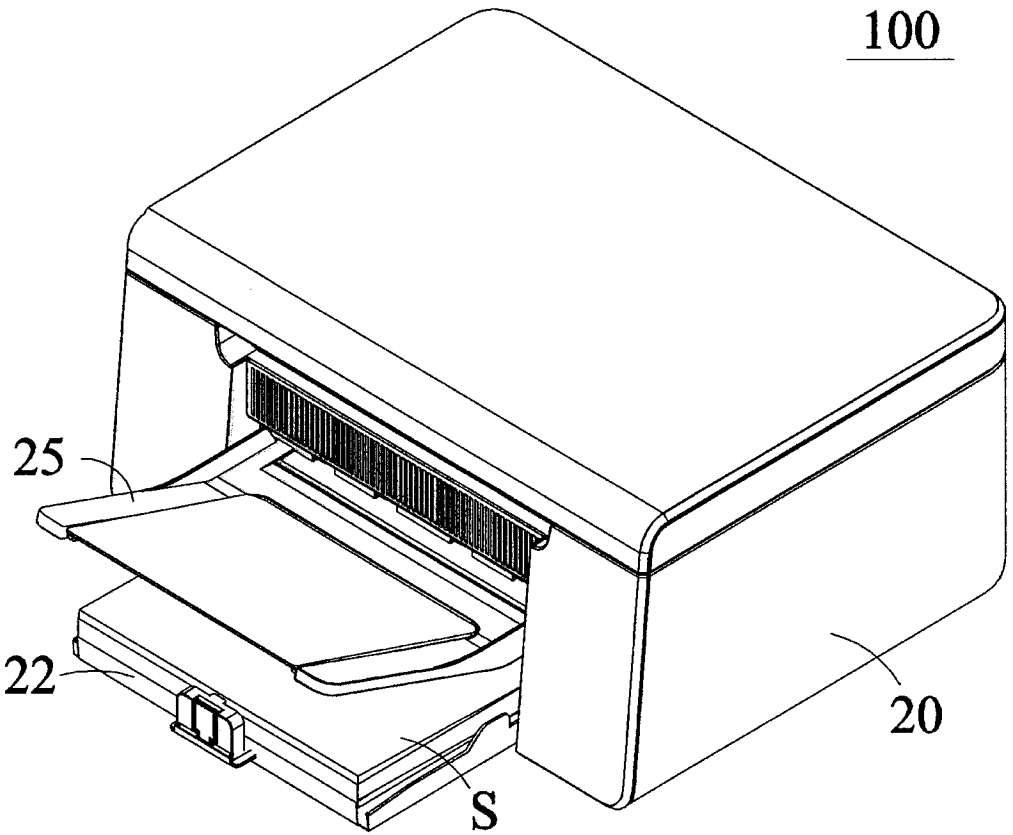
FIG. 2 is a pictorial view showing a peripheral capable of being refilled with an image forming agent according to the preferred embodiment of this disclosure.
Figure 3:
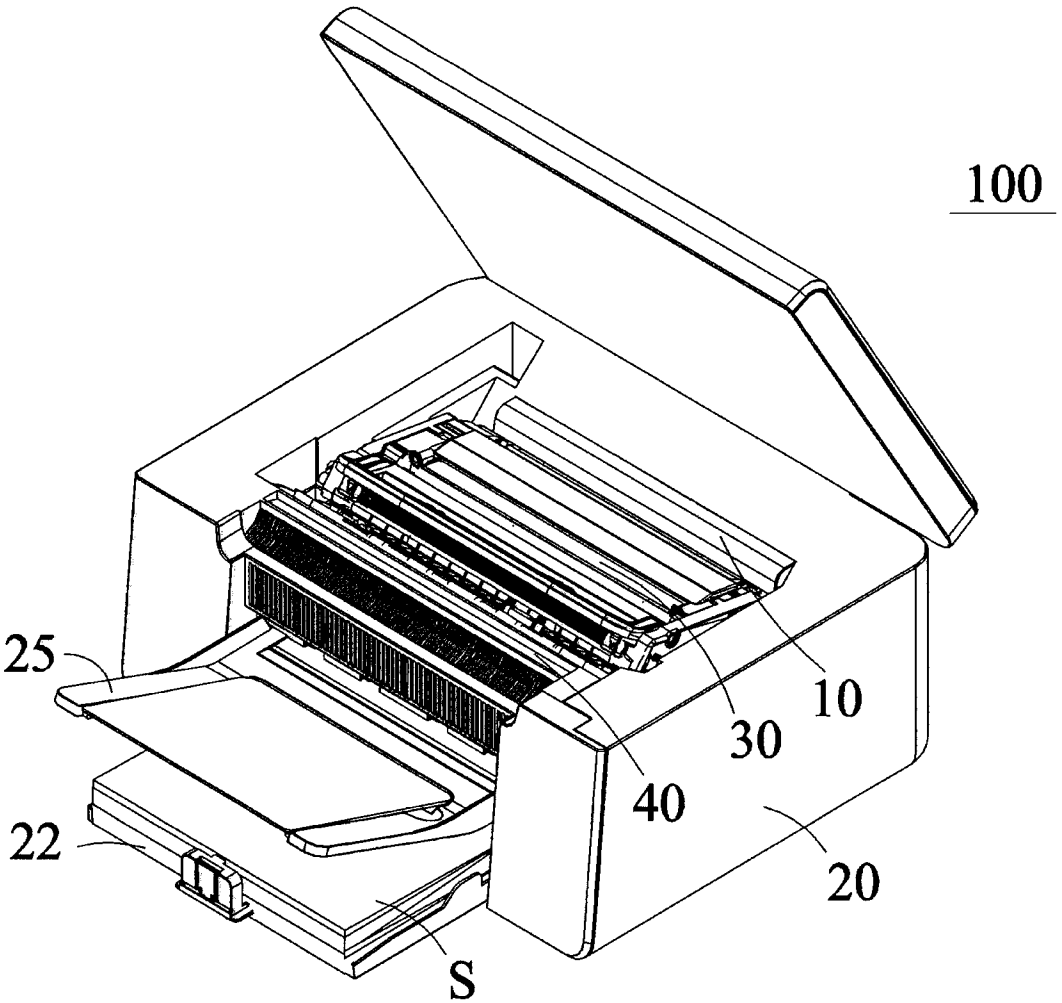
FIG. 3 is a schematic internal view showing the peripheral and an image forming agent storage member of FIG. 2.

FIG. 2 is a pictorial view showing a peripheral capable of being refilled with an image forming agent according to the preferred embodiment of this disclosure. FIG. 3 is a schematic internal view showing the peripheral and an image forming agent storage member of FIG. 2. Referring to FIGS. 2 and 3, the peripheral 100 has a casing 20, an image forming agent storage member 10, an imaging forming member 30 and a fixation member 40. The imaging forming member 30 disposed inside the casing 20 forms a predetermined image on a medium S (e.g., a sheet or a transparent slide). Although an example drawing of this embodiment shows a drum of a laser printer as the imaging forming member, the disclosure is not restricted thereto. The imaging forming member 30 may also be an ink-jet print head of an ink-jet printer, or any other imaging forming member capable of forming a physical image on the medium S. The image forming agent storage member 10 is disposed on one side of the imaging forming member 30. The fixation member 40 is also disposed inside the casing 20 and fixes the image formed by the imaging forming member 30 onto the medium S. For example, this embodiment takes the example of a hot pressing roller set for fixing the image forming agent, such as the toner, onto the surface of the medium S at the high-temperature and high-pressure condition. However, this disclosure is not restricted thereto. The peripheral 100 further comprises a supply tray 22 for supporting the media S. The media S are imaged by the imaging forming member 30, fixed by the fixation member 40, and finally discharged to a discharge tray 25 and stacked over there. The peripheral 100 may be a printer, a digital machine, a multi-function peripheral or the like. The image forming agent storage member 10 has a long side smaller than the short side and substantially perpendicular to the discharge direction of the printed medium S.

Figure 4:
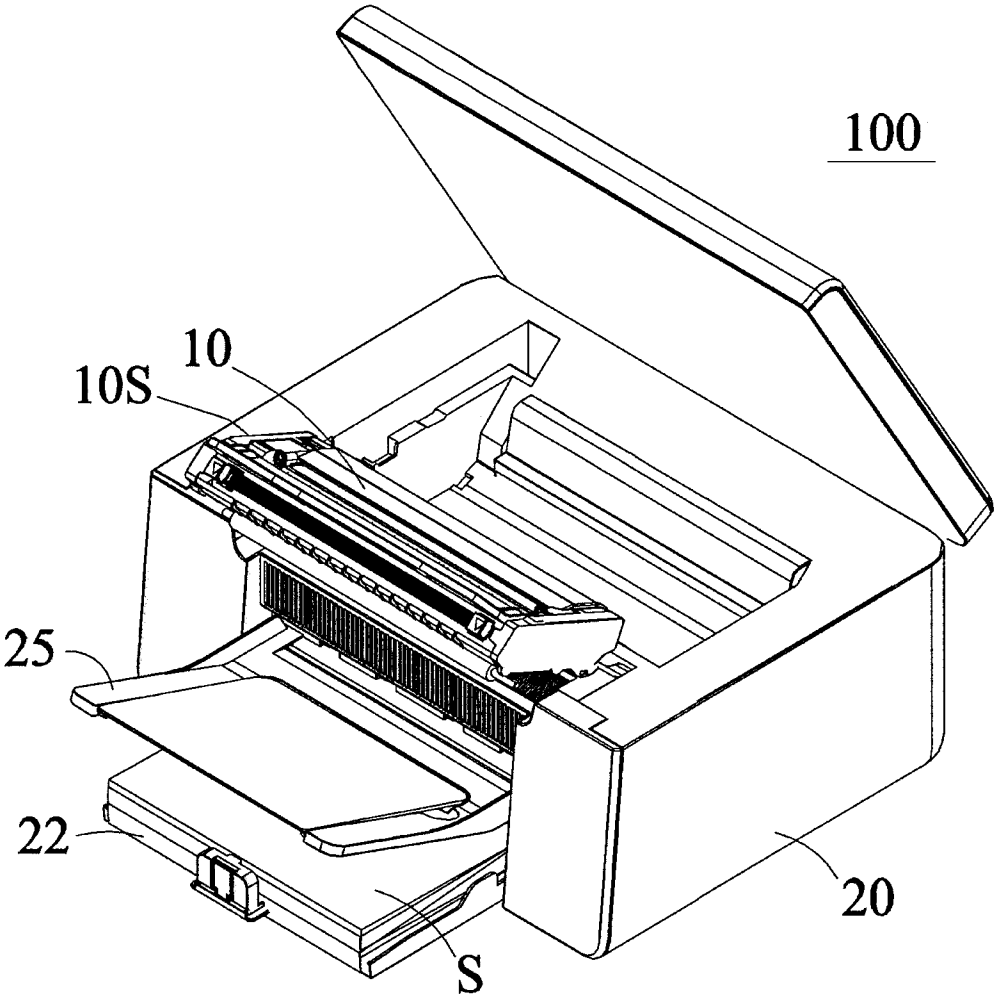
FIG. 4 is a schematic view showing the imaging forming member, the image forming agent storage member and the casing of FIG. 2, which are separated.

FIG. 4 is a schematic view showing the imaging forming member, the image forming agent storage member and the casing of FIG. 2, which are separated. As shown in FIG. 4, the image forming agent storage member 10 may be disassembled from the casing 20.

Figure 5A:
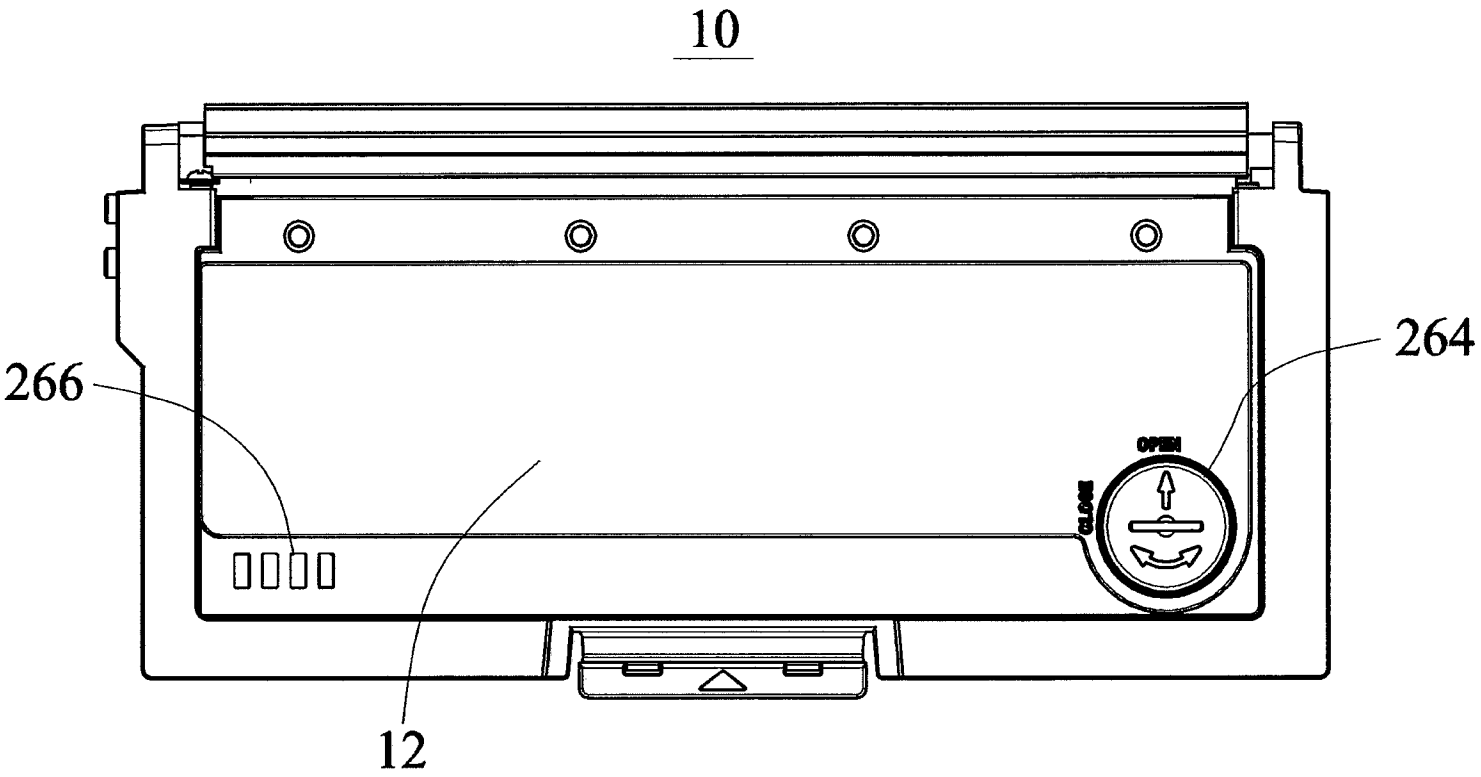
FIG. 5*a* is a top view showing the image forming agent storage member according to the preferred embodiment of this disclosure.
Figure 5B:
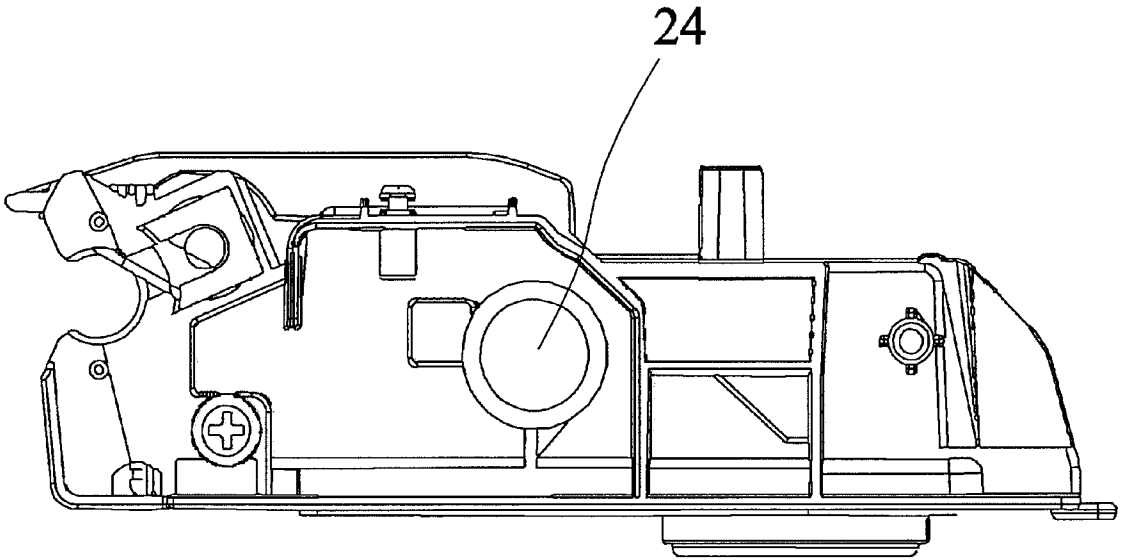
FIG. 5*b* is a left view showing the image forming agent storage member according to the preferred embodiment of this disclosure.
Figure 5C:
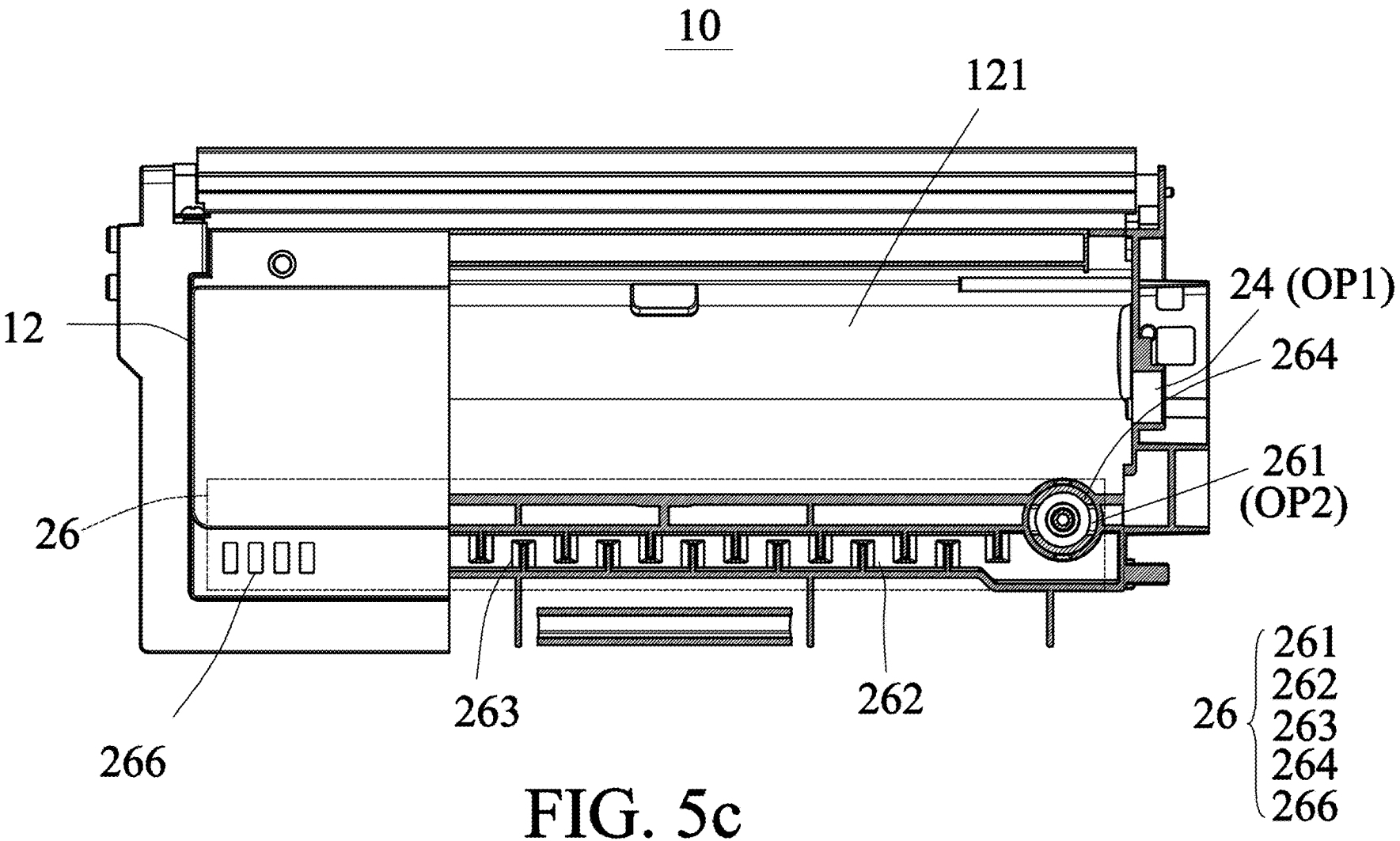
FIG. 5*c* is a semi-perspective view showing the image forming agent storage member according to the preferred embodiment of this disclosure.

FIGS. 5*a* to 5*c* are schematic views showing the image forming agent storage member according to the preferred embodiment of this disclosure. FIG. 5*a* is a top view showing the image forming agent storage member according to the preferred embodiment of this disclosure. FIG. 5*b* is a left view showing the image forming agent storage member according to the preferred embodiment of this disclosure. FIG. 5*c* is a semi-perspective view showing the image forming agent storage member according to the preferred embodiment of this disclosure. Referring to FIGS. 5*a* to 5*c*, the image forming agent storage member 10 comprises a housing 12, an image forming agent supply port 24 and a fluid discharge mechanism 26. The housing 12 carries or accommodates the image forming agent (not shown), which may be a substance (e.g., toner, carbon powder, or ink) that can be applied onto the medium S, in an inner chamber 121 of the housing 12. The image forming agent supply port 24 is disposed on one end of the housing 12. The image forming agent may be injected from the image forming agent supply port 24 into the housing 12. The image forming agent supply port 24 may further comprise a plug cover for normally closing an opening OP1 of the image forming agent supply port 24, wherein the plug cover can be removed when the image forming agent is to be added. Compared with the image forming agent supply port 24, the fluid discharge mechanism 26 is disposed on a surface on the other end of the housing 12 and away from the image forming agent supply port 24. This is because the image forming agent cannot be easily and fully refilled into the image forming agent storage member 10 if the distance for the fluid flowing between the two holes is too short. So, the housing 12 or a stopper block may be configured to lengthen the fluid flowing path in addition to the increase of the distance between the two holes.

As shown in FIG. 5*b*, when the image forming agent is refilled, the image forming agent supply port 24 is disposed on one side surface of a short side of the image forming agent storage member 10 (or on a side surface 10S of the image forming agent storage member 10 of FIG. 4). When the user is refilling the toner, the image forming agent storage member 10 is in an upright state while the image forming agent supply port 24 is disposed on the top. The toner is refilled from the top of the long side of the housing 12, wherein the long side of the housing 12 extends longitudinally in a substantially horizontal direction when the image forming agent storage member 10 is installed into the peripheral 100 (laser printer) to perform printing (see also FIGS. 2 to 4) so that a weight of the toner (carbon powder) presses the fluid discharge mechanism 26 through the long side of the housing 12 in a direction perpendicular to the long side of the housing 12 (see also FIGS. 2 to 4), and this satisfies the human mechanics for the user so that the user's force is smaller. The mechanism can be configured so that the toner can be refilled into the housing 12 at a time.

As shown in FIG. 5*c*, the fluid discharge mechanism 26 is disposed on the long side of the image forming agent storage member 10, and the image forming agent can naturally fall downwards by way of gravity and cannot leave the image forming agent storage member 10 in the refilling process. When the image forming agent supply port 24 receives the image forming agent filled into the housing 12, the fluid inside the housing 12 is discharged through the fluid discharge mechanism 26. The fluid discharge mechanism 26 comprises a shielding member 264 disposed on one end of the fluid discharge mechanism 26, wherein positions of the shielding member 264 and the image forming agent supply port 24 on the housing 12 do not correspond to each other. The shielding member 264 and the image forming agent supply port 24 may be disposed on the same surface or two neighboring surfaces of the housing 12 (e.g., side and top surfaces), and the distance therebetween on the housing 12 is not particularly restricted. The fluid may comprise any gas, liquid or solid that can flow inside the housing 12. In addition, the fluid discharge mechanism 26 further restricts the image forming agent contained in the fluid from leaving the image forming agent storage member 10. The mechanism thereof will be described in the following.

Preferably, the length of the fluid discharge mechanism is longer than one half of the long side of the housing 12. The fluid discharge mechanism restricts the image forming agent from leaving the image forming agent storage member.

Figure 6A:
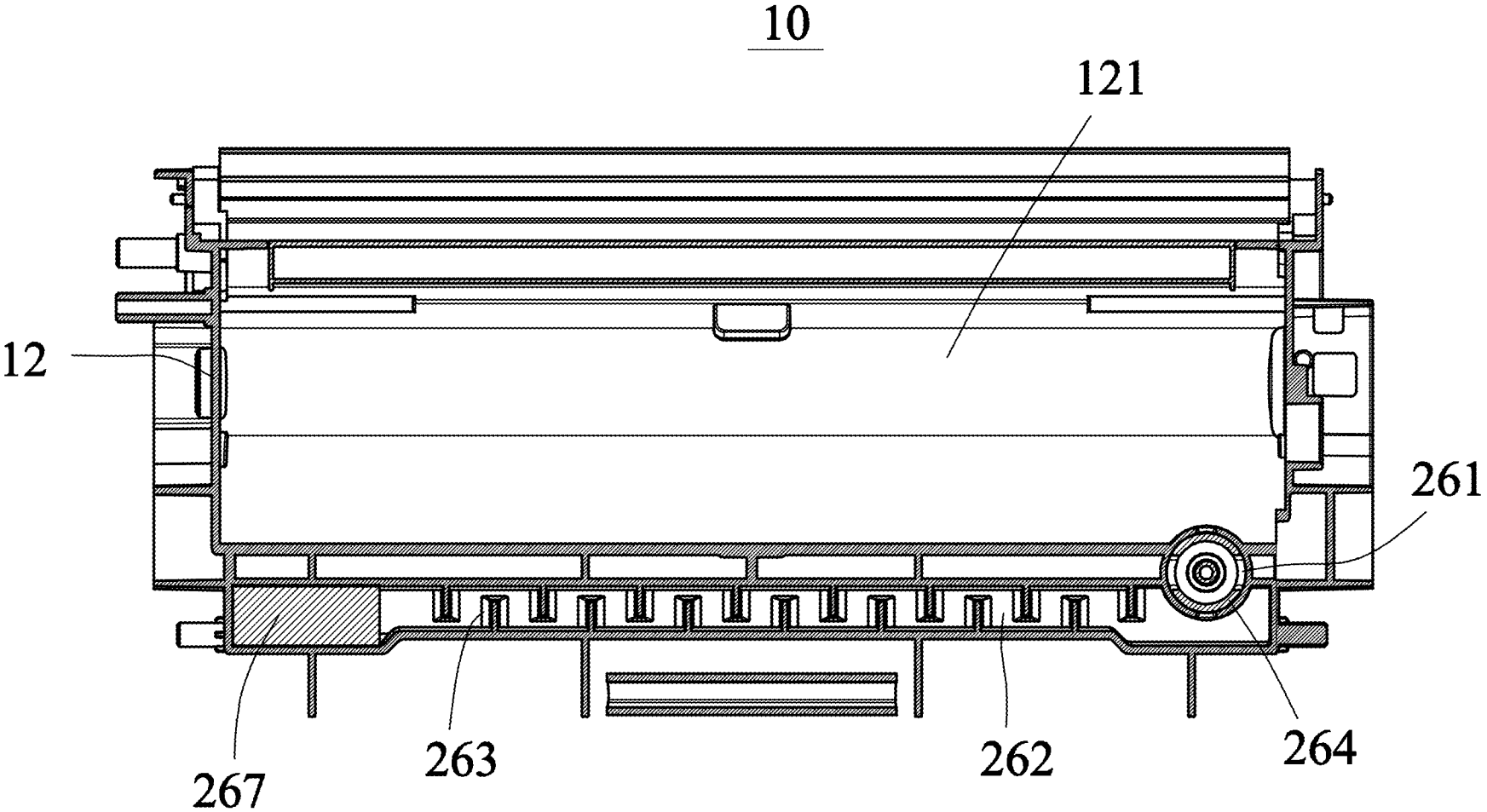
Figure 6B:
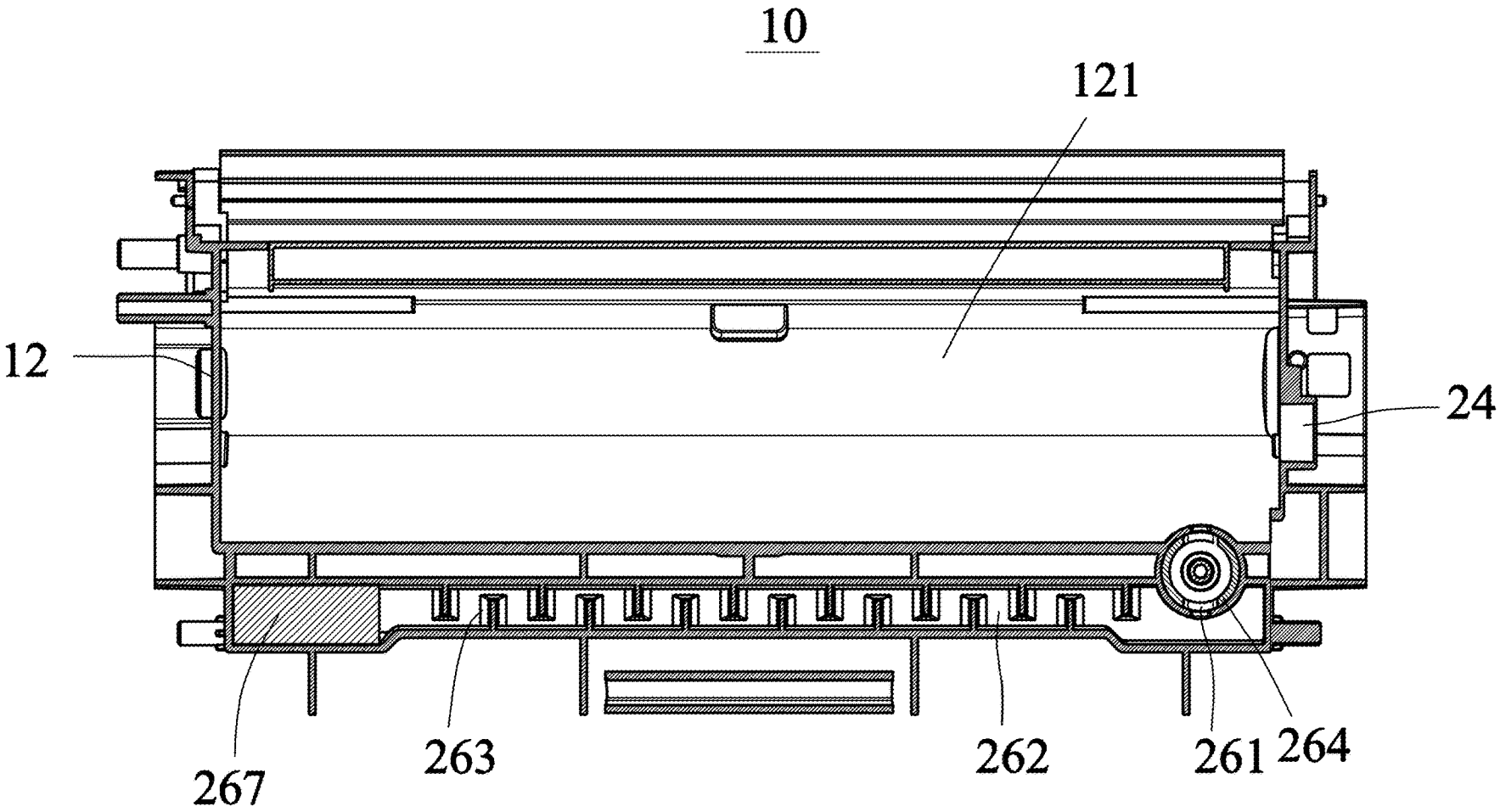

The fluid discharge mechanism 26 further comprises a discharge port 261, a discharge channel 262 and one or multiple stopping members 263. In this embodiment shown in FIG. 5*c*, an opening OP2 of the discharge port 261 of the shielding member 264 is not positioned in direct alignment with an opening OP1 of the image forming agent supply port 24. A distal end of the channel of the fluid discharge mechanism 26 is formed with apertures 266. FIGS. 6*a* and 6*b* are schematic views showing controlling of a shielding member in a fluid discharge mechanism, wherein FIG. 6*a* shows the closed state of the shielding member 264, and FIG. 6*b* shows the opened state of the shielding member 264. As shown in the closed state of FIG. 6*a*, the discharge port 261 is disposed in the shielding member 264 and in parallel with the discharge channel 262 so that the inner chamber 121 of the housing is discommunicated from the discharge channel 262. So, the fluid inside the housing 12 cannot leave the housing 12 through the discharge port 261. As shown in the opened state of FIG. 6*b*, the discharge port 261 is disposed in the shielding member 264, and is perpendicular to the discharge channel 262, so that the inner chamber 121 of the housing 12 communicates with the discharge channel 262 disposed on the long side of the housing 12, and the fluid inside the housing 12 leaves the housing 12 through the discharge port 261. One end of the discharge channel 262 is connected to the outer side of the discharge port 261 and allows the fluid to pass. The stopping member 263 disposed inside the discharge channel 262 restricts the image forming agent from leaving the image forming agent storage member 10, and makes the path of the discharge channel 262 become much more curved and extended. In this embodiment, the stopping member 263 is formed as a fence for stopping the image forming agent mixed with the fluid that is discharged from the discharge port 261, and forces the image forming agent to accumulate in the discharge channel 262 so as to prevent the image forming agent from spreading out of the image forming agent storage member 10. However, this disclosure is not limited to this embodiment. The stopping member 263 may also be in the form of a mesh, a sheet, or any mechanism that is capable of stopping the image forming agent from flowing out of the image forming agent storage member.

Referring to FIG. 6*a*, the shielding member 264 stops the fluid inside the housing 12 from discharging through the discharge port 261 in the closed state. When the user wants to refill the image forming agent, the user only needs to switch the shielding member 264 to the opened state (see FIG. 6*b*) so that the inner chamber of the housing 12 communicates with the discharge channel 262, and the image forming agent can be injected or refilled into the housing 12 through the image forming agent supply port 24 smoothly. After the refilling is completed, the shielding member 264 is switched back to the closed state to stop any fluid or image forming agent from leaving the image forming agent storage member 10.

The fluid inside the housing is controlled to stay in or leave the inner chamber of the housing by controlling the closed or opened state of the discharge port of the shielding member 264.

Preferably, the discharge port of the shielding member 264 can be opened or closed by a clockwise or counterclockwise rotation.

Preferably, the shielding member 264 is a knob.

Preferably, the stopping members 263 are arranged alternately in a left-to-right direction.

Preferably, the stopping members 263 are arranged alternately in a top-to-bottom direction.

Figure 7A:
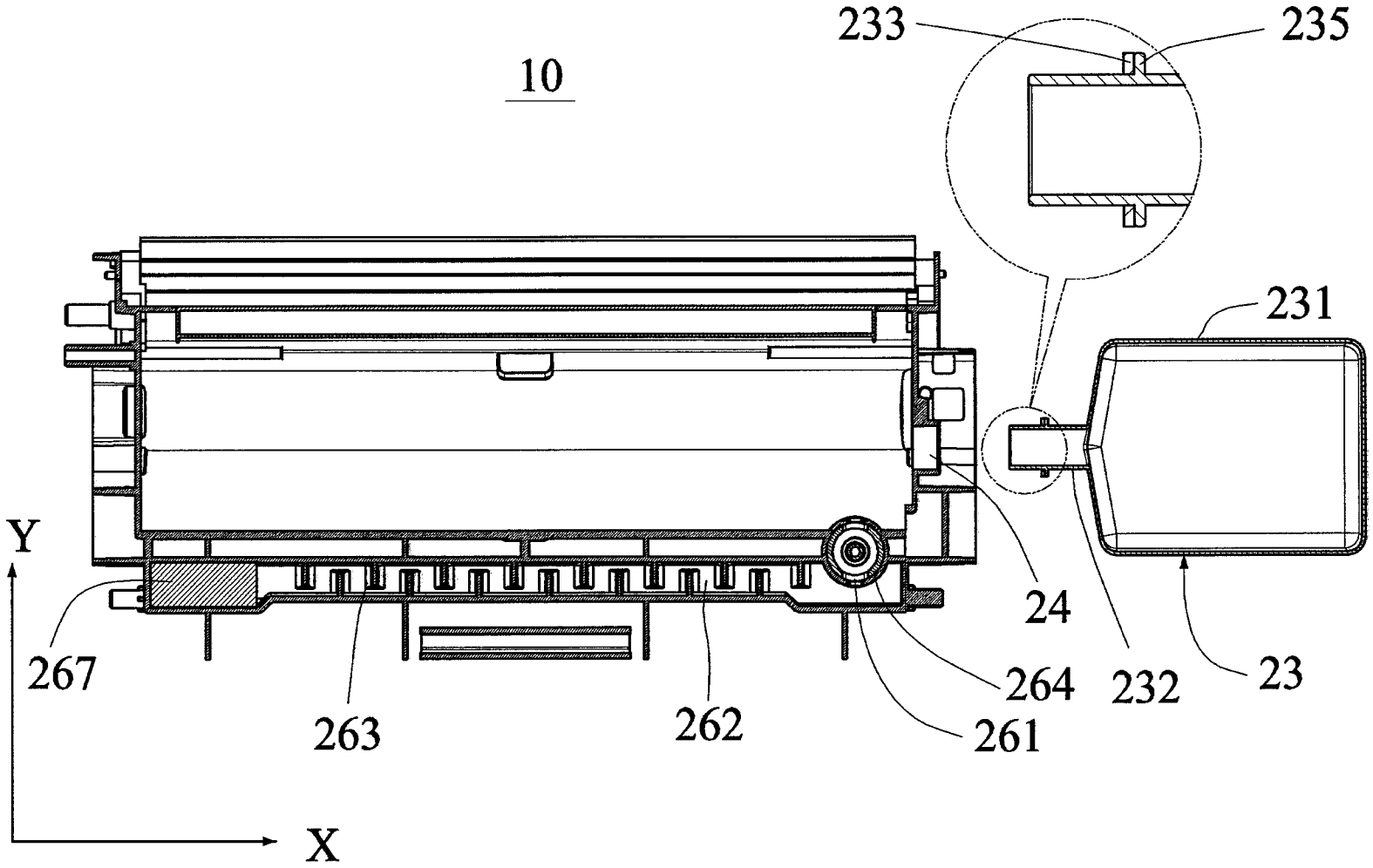
FIGS. 7*a* to 7*c* are schematic views showing the image forming agent storage member in use.
Figure 7B:
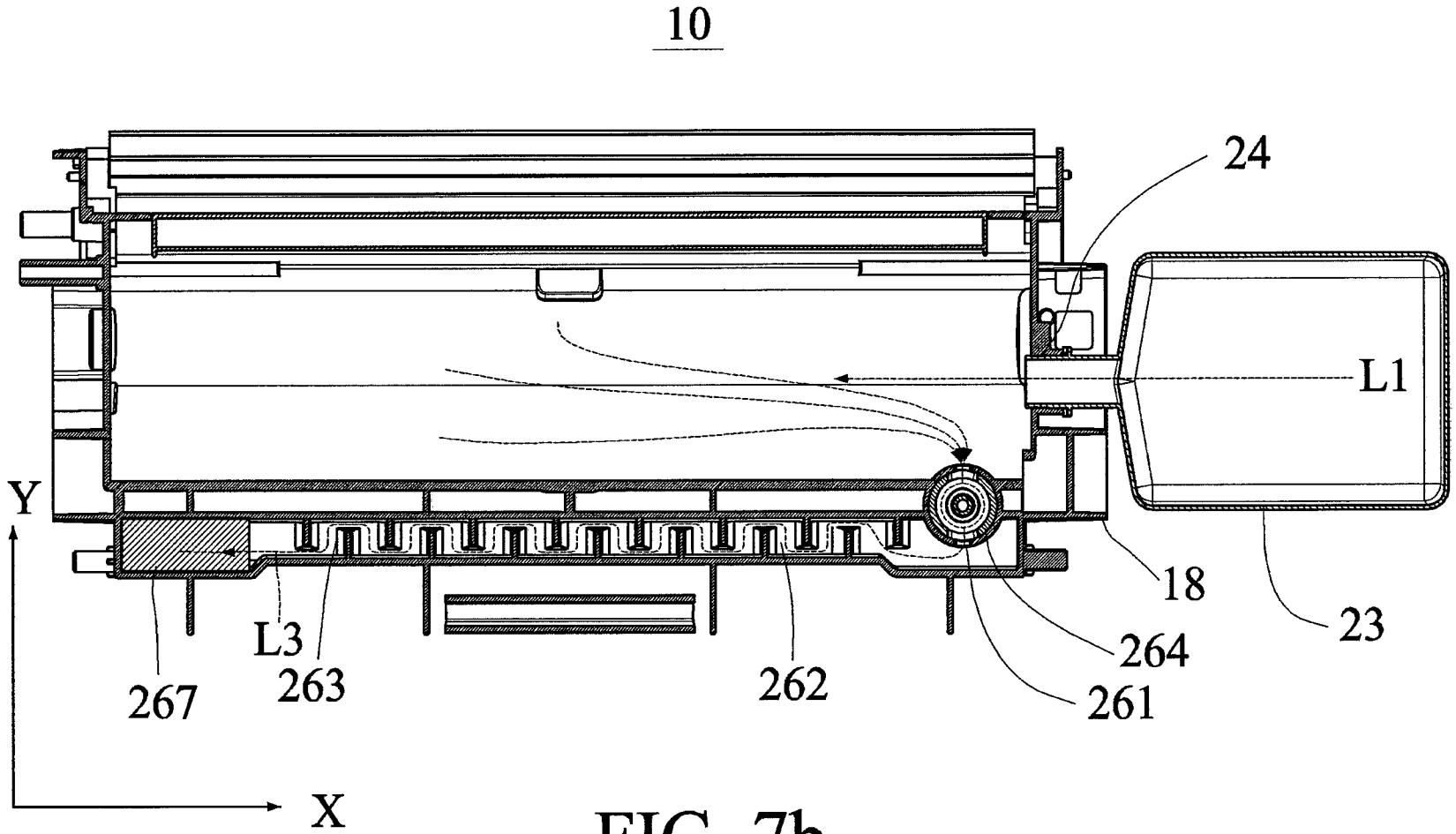

Referring to FIGS. 5*a* to 5*c*,6*a* ,6*b* and 7*b*, the fluid flows from the discharge port 261 of the shielding member 264 to the discharge channel 262 along the dashed line arrow depicted in FIG. 7*b*, and the stopping member 263 stops the image forming agent mixed within the fluid. The fluid flows through the curved discharge channel 262, and finally leaves the image forming agent storage member 10 through the apertures 266 (depicted in the dashed line). The stopping member 263 functions so that the amount of the image forming agent that can reach the area ranging from the distal end of the discharge channel 262 to the aperture 266 is relatively smaller, so the discharged fluid is safe and clean, and the apertures 266 cannot be easily blocked and need not to be cleaned or replaced frequently. In this embodiment, the aperture 266 is a venthole formed on the upper cover of the image forming agent storage member 10, but this disclosure is not restricted thereto. The aperture may be in the form of a void or a narrow slit that allows the fluid to discharge. For example, a filter formed with the apertures 266, a filter attached to the housing 12, or a filter formed with ventholes can be used.

That is, the fluid discharge mechanism 26 is provided for the purpose of discharging the fluid from the inner chamber of the image forming agent storage member 10, and assisting the image forming agent in injecting into the image forming agent storage member 10 from the image forming agent supply port 24 smoothly. In addition, the stopping member 263 disposed in the discharge channel 262 can restrict the image forming agent, mixed within the fluid, from being deposited and accumulated in the fluid discharge mechanism 26 and from spreading out to affect the human body and the environment. With such the mechanism, the image forming agent can be conveniently refilled, the light structure can be obtained, and the safe and environment protective effects can be achieved.

Figure 7C:
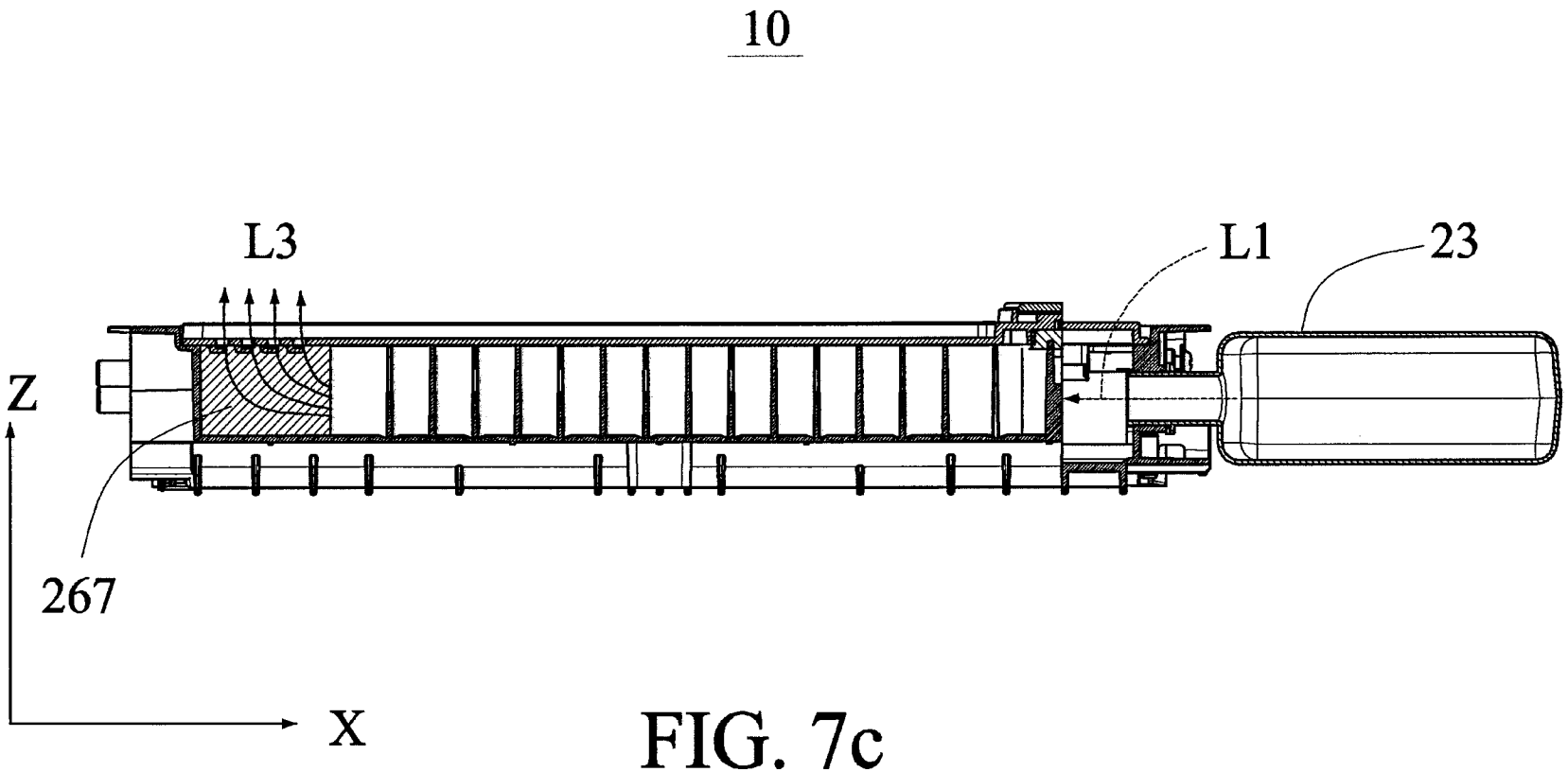

FIG. 7*a* also shows the relative position between the refilling bottle 23 and the image forming agent supply port 24 as well as an enlarged structure view of the bottom mouth of the refilling bottle. A hollow body 231 of the refilling bottle 23 stores the image forming agent, a bottle mouth 232 of the refilling bottle 23 is connected to the hollow body 231, and the bottle mouth 232 has a cylindrically shaped inner chamber. FIG. 7*a* also shows the schematic view of the positions of the bottle mouth 232 of the refilling bottle 23 and the image forming agent supply port 24 when the image forming agent is refilled. The outer peripheral dimension of the bottle mouth 232 of the refilling bottle 23 is substantially equal to the inner peripheral dimension of the image forming agent supply port 24, so that the bottle mouth 232 of the refilling bottle 23 can be disposed within the image forming agent supply port 24. The bottle mouth 232 of the refilling bottle 23 further comprises a stopper portion 235 for restricting a depth where the bottle mouth 232 of the refilling bottle 23 is placed into the image forming agent supply port 24, so that the bottle mouth 232 is only partially inserted into the image forming agent supply port 24. A buffer layer 233 for stopping the image forming agent from overflowing through the connection portion between the stopper portion 235 and the image fainting agent supply port 24 is further disposed on the stopper portion 235. That is, the hermetic contact or connection between the stopper portion 235 and the image forming agent supply port 24 can be achieved through the buffer layer 233. The stopper portion 235 and the refilling bottle 23 may be integrally formed or may be combined by way of engagement. The stopper portion 235 is a flange formed on a central portion of the bottle mouth 232, and is separated from the hollow body 231 by a distance. The stopper portion 235 can be entirely accommodated within an outer housing 18 of the image forming agent storage member 10 (see FIG. 7*b*). The buffer layer 233 may be made of foam. In another example, the buffer layer 233 is formed or disposed on the image forming agent storage member 10 to achieve the hermetic contact with the refilling bottle 23, and the plug cover of the image forming agent supply port 24. Thus, the combination of the image forming agent storage member 10 and the refilling bottle 23 provided by this disclosure is advantageous to the refilling operation performed by the user. As shown in FIGS. 7*a* and 7*b*, when the image forming agent is being refilled, the hollow body 231 is separated from the outer housing 18 of the image forming agent storage member by a distance. Furthermore, the fluid discharge mechanism 26 further comprises the shielding member 264 having a revealing state where the discharge port 261 is a revealed, and a shielding state where the discharge port 261 is shielded. FIGS. 7*a* to 7*c* are schematic views showing the image forming agent storage member in use. The image forming agent refilling bottle 23 refills the image forming agent into the image forming agent storage member 10 from the image forming agent supply port 24 along the negative X direction. The bottle mouth is configured to be in hermetic contact with the image forming agent supply port 24 to prevent the image forming agent from entering the storage member 10 and the internal air from being discharged from the gap between the image forming agent supply port 24 and the bottle mouth. When the image forming agent is entering the storage member 10, the excess air can be discharged from the opened discharge port 261 of the shielding member 264, as indicated by the path L3, to prevent the nonessential loss of the image forming agent, to effectively decrease the frequency of cleaning the fluid discharge mechanism 26, and to lengthen the lifetime. Referring to FIG. 7*b*, the fluid discharge mechanism 26 further includes: a first partition plate 268 and a second partition plate 269 disposed opposite each other; a circuitous discharge channel 262, wherein one end of the circuitous discharge channel 262 is connected to the shielding member 264; and stopping members 263, which are disposed in the circuitous discharge channel 262 and restrict the image forming agent from leaving the image forming agent storage member 10. The stopping members 263 include: first stopping members 263A disposed on the first partition plate 268; and second stopping members 263B disposed on the second partition plate 268 opposite to the first partition plate 269. The first stopping members 263A and the second stopping members 263B are staggered to form the circuitous discharge channel 262.

A filtering layer 267 for filtering the image forming agent in the discharge channel 262 and cleaning the air discharged when the image forming agent is refilled is further disposed at the apertures 266 of the discharge channel 262. The filtering layer 267 may be a filter, foam, non-woven cloth, gauze, activated carbon, a high-efficiency particulate air (HEPA) filter, or the like. Thus, the air stream L1 flows in the negative X direction, and the gas is discharged into the discharge channel 262 from the discharge port 261 in the negative Y direction, and finally discharged from the filtering layer 267 along the Z-direction path L3. In another example, the discharge path L3 may also in the positive or negative X direction, or in the positive or negative Y direction.

In summary, this disclosure provides an image forming agent storage member capable of being refilled with the image forming agent and a peripheral using this image forming agent storage member, so that the image forming agent can be easily refilled and the image forming agent can be stopped from leaving the image forming agent storage member. The structure is light, the consumable material consumption is low, and the environment protective, convenient and safe effects can be obtained. It is possible to stop the image forming agent from over flowing, and it is advantageous to the user's refilling operation.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An image forming agent storage member used in a laser printer, the image forming agent storage member comprising:

a housing carrying an image forming agent, which is carbon powder, in an inner chamber of the housing;

an image forming agent supply port disposed on one side surface of a short side of the housing; and a fluid discharge mechanism disposed on a long side of the housing, which extends longitudinally in a substantially horizontal direction when the image forming agent storage member is installed into the laser printer to perform printing;

wherein when the image forming agent supply port receives the image forming agent added into the housing, a fluid in the housing is discharged through the fluid discharge mechanism;

wherein the fluid discharge mechanism comprises a shielding member, and an opening of a discharge port of the shielding member is not positioned in direct alignment with an opening of the image forming agent supply port, wherein the discharge port of the shielding member is controlled to open to communicate the inner chamber of the housing with a discharge channel of the fluid discharge mechanism disposed on the long side of the housing when a user is refilling the image forming agent into the housing, and the discharge port of the shielding member is controlled to close to discommunicate the inner chamber of the housing from the discharge channel after the user finishes refilling of the image forming agent.

2. The image forming agent storage member according to claim 1, wherein a length of the fluid discharge mechanism is longer than one half of the long side of the housing.

3. The image forming agent storage member according to claim 1, wherein the fluid discharge mechanism restricts the image forming agent from leaving the image forming agent storage member, wherein a weight of the carbon powder presses the fluid discharge mechanism through the long side of the housing in a direction perpendicular to the long side of the housing when the image forming agent storage member is installed into the laser printer to perform printing.

4. The image forming agent storage member according to claim 1, wherein the shielding member is disposed on one end of the fluid discharge mechanism.

5. The image forming agent storage member according to claim 4, wherein the fluid discharge mechanism further comprises:

stopping members, which are disposed in the discharge channel and restrict the image forming agent from leaving the image forming agent storage member.

6. The image forming agent storage member according to claim 5, wherein the stopping members extend and lengthen a path of the discharge channel.

7. The image forming agent storage member according to claim 6, wherein the stopping members are arranged alternately in a left-to-right direction.

8. The image forming agent storage member according to claim 5, wherein the stopping members are arranged alternately in a top-to-bottom direction.

9. The image forming agent storage member according to claim 4, wherein the discharge port of the shielding member is closed or opened to control the fluid to stay or leave the housing.

10. The image forming agent storage member according to claim 9, wherein the discharge port of the shielding member is controlled to close or open by way of rotation.

11. The image forming agent storage member according to claim 10, wherein the shielding member is a knob.

12. The image forming agent storage member according to claim 1, wherein the shielding member has a revealing state where the discharge port is revealed, and a shielding state where the discharge port is shielded; and when the shielding member is in the shielding state, the fluid in the housing is stopped from discharging from the discharge port.

13. The image forming agent storage member according to claim 1, wherein a filtering layer is further disposed on a distal end of the fluid discharge mechanism, and filters the image forming agent from the fluid discharge mechanism.

14. The image forming agent storage member according to claim 13, wherein the filtering layer comprises a filter, foam, non-woven cloth, gauze, activated carbon or a high-efficiency particulate air (HEPA) filter.

15. An image forming agent storage member used in a laser printer, the image forming agent storage member comprising:

a housing carrying an image forming agent, which is carbon powder, in an inner chamber of the housing;

an image forming agent supply port disposed on one side surface of a short side of the housing; and a fluid discharge mechanism disposed on a long side of the housing, wherein a weight of the carbon powder presses the fluid discharge mechanism through the long side of the housing in a direction perpendicular to the long side of the housing when the image forming agent storage member is installed into the laser printer to perform printing;

wherein when the image forming agent supply port receives the image forming agent added into the housing, a fluid in the housing is discharged through the fluid discharge mechanism;

wherein the fluid discharge mechanism comprises a shielding member, and an opening of a discharge port of the shielding member is not positioned in direct alignment with an opening of the image forming agent supply port;

wherein the fluid discharge mechanism further comprises:

a first partition plate and a second partition plate disposed opposite each other;

a circuitous discharge channel, wherein one end of the circuitous discharge channel is connected to the shielding member; and stopping members, which are disposed in the circuitous discharge channel and restrict the image forming agent from leaving the image forming agent storage member, wherein the stopping members comprise:

first stopping members disposed on the first partition plate; and second stopping members disposed on the second partition plate opposite to the first partition plate, wherein the first stopping members and the second stopping members are staggered to form the circuitous discharge channel.

16. The image forming agent storage member according to claim 15, wherein the fluid discharge mechanism is disposed on the long side of the housing, which extends longitudinally in a substantially horizontal direction when the image forming agent storage member is installed into the laser printer to perform printing.

17. A laser printer, comprising:

a casing; and an image forming agent storage member installed in the casing, wherein the image forming agent storage member comprises:

a housing carrying an image forming agent, which is carbon powder, in an inner chamber of the housing;

an image forming agent supply port disposed on one side surface of a short side of the housing; and a fluid discharge mechanism disposed on a long side of the housing, which extends longitudinally in a substantially horizontal direction when the image forming agent storage member is installed into the laser printer to perform printing;

wherein when the image forming agent supply port receives the image forming agent added into the housing, a fluid in the housing is discharged through the fluid discharge mechanism;

wherein the fluid discharge mechanism comprises a shielding member, and an opening of a discharge port of the shielding member is not positioned in direct alignment with an opening of the image forming agent supply port, wherein the discharge port of the shielding member is controlled to open to communicate the inner chamber of the housing with a discharge channel of the fluid discharge mechanism disposed on the long side of the housing when a user is refilling the image forming agent into the housing, and the discharge port of the shielding member is controlled to close to discommunicate the inner chamber of the housing from the discharge channel after the user finishes refilling of the image forming agent.

* * * * *